US005480080A

United States Patent [19]

Ferguson

[11] Patent Number: 5,480,080

[45] Date of Patent: Jan. 2, 1996

[54] METHOD AND APPARATUS FOR CUTTING DECORATIVE GIFT-WRAP PAPER

[76] Inventor: Lee T. Ferguson, 7148 Lantana Ter., Carlsbad, Calif. 92009

[21] Appl. No.: 272,676

[22] Filed: Jul. 8, 1994

[51] Int. Cl.[6] ..... B26F 3/02

[52] U.S. Cl. ..... 225/1; 225/77; 225/91

[58] Field of Search ..... 225/1, 56, 66, 225/77, 91, 46, 47

[56] References Cited

U.S. PATENT DOCUMENTS

| | | | |
|---|---|---|---|
| 445,009 | 1/1891 | Atkinson | 225/91 X |
| 1,218,670 | 3/1917 | Kramer . | |
| 1,718,143 | 6/1929 | Hancock . | |
| 1,821,947 | 9/1931 | Ross . | |
| 1,896,119 | 2/1933 | Wilson . | |
| 1,915,736 | 6/1933 | Hurlbut . | |
| 1,939,812 | 12/1933 | Hamersley | 225/77 X |
| 1,967,119 | 7/1934 | Gluck | 225/46 |
| 2,732,145 | 1/1956 | Serrone | 242/55.5 |
| 2,819,851 | 1/1958 | Robertson | 225/77 X |
| 3,159,323 | 12/1964 | Hawk | 225/49 |
| 3,173,591 | 3/1965 | Sax et al. | 225/66 |
| 3,425,606 | 2/1969 | Burke | 225/77 |
| 3,510,034 | 5/1970 | Caskey et al. | 225/77 |
| 3,542,268 | 11/1970 | Schramm | 225/9 |
| 3,559,857 | 2/1971 | Van Dyck | 225/56 |
| 4,858,807 | 8/1989 | Cvek | 225/91 X |

*Primary Examiner*—Eugenia Jones
*Attorney, Agent, or Firm*—Richard L. Gausewitz

[57] ABSTRACT

Apparatus and method for cutting gift-wrap paper, which comprises an elongate straight V-sectioned element that is easily hand-held by one hand of an operator. The element has a cutting edge along one side, which cuts the paper after the desired amount thereof has been pulled off the roll.

6 Claims, 1 Drawing Sheet

FIG. 1.
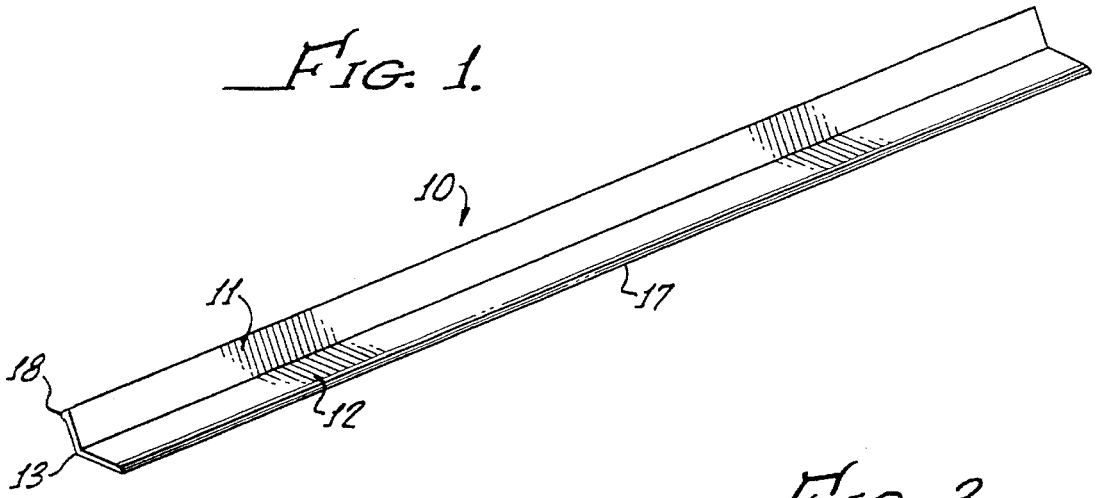
FIG. 2.
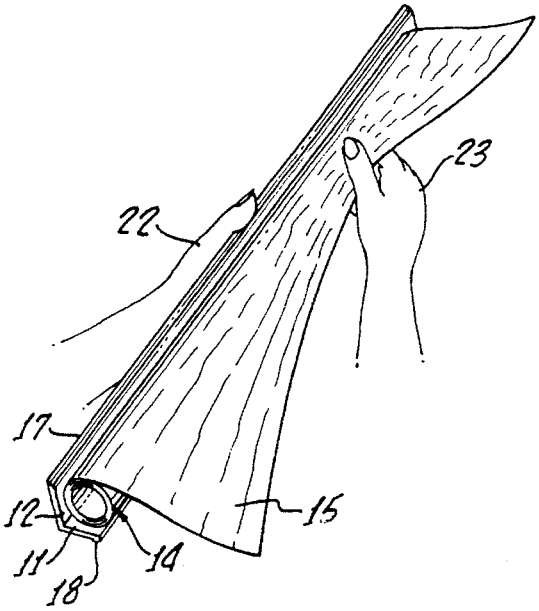
FIG. 3.
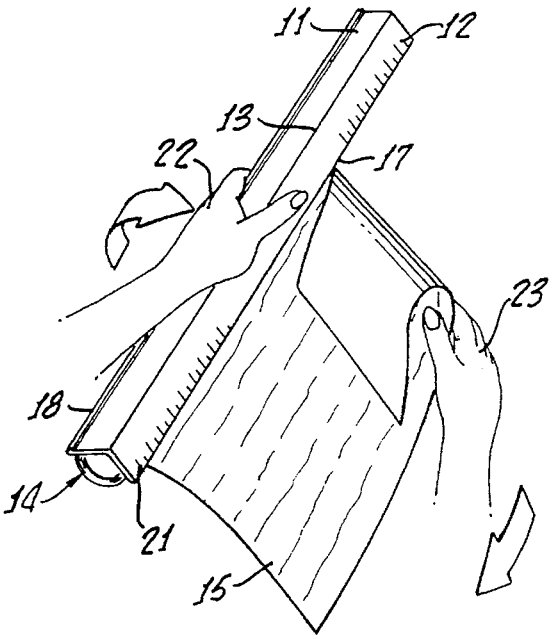
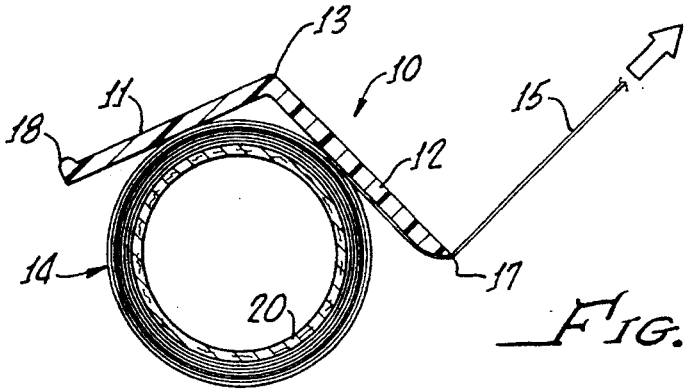
FIG. 4.

METHOD AND APPARATUS FOR CUTTING DECORATIVE GIFT-WRAP PAPER

BACKGROUND OF THE INVENTION

The present method and apparatus are particularly applicable relative to the large-scale frenzied gift-wrapping that occurs throughout the United States just before major holidays such as, for example, Christmas and Hanukkah. Especially on such important occasions, it is common for one or more persons to be sitting or standing around a dining room table or card table-or kneeling or sitting on the floor-surrounded by numerous long rolls of conventional decorative and colored gift-wrap paper, and also surrounded by the gifts to be wrapped. Typically, the gift-wrap rolls are long and each has a cylindrical tubular cardboard core. It is common to switch from one pattern or color of decorative paper to another as the packages are progressively wrapped, instead of using the same paper for all packages.

In a conventional scenario, an often tired and harried operator slowly uses scissors (that may be dangerous) to cut a length of the gift-wrap paper. The cut is often made as much by lunging as by cutting, and the cut can often be characterized by tearing. In any event, it is common for the cutting to result in a zigzag configuration. Frustration is a frequent result of the crooked-cutting of gift-wrap paper by use of scissors.

Over the decades, it has on several occasions been proposed to cut paper from rolls thereof by use of blade-like elongate elements, the ends of which hook into the ends of the rolls so that a partial bearing action is created between the blade and the roll. Such devices, however, are not satisfactory for reasons including—among others—the difficulty of shifting from one roll of paper to another.

To be fully satisfactory, the apparatus must permit rapid shifting from one roll to another, must be cheap to manufacture, must be easy to use, and must be hand-held so that it can be used in any location and in whatever position the operator elects to use. The apparatus and method must be simple and must be capable of cutting a long straight edge in only a few seconds, and with a very short elapsed time between the instant when the operator decides what roll is to be used and the instant when cutting is completed. Other requirements for a fully successful apparatus to be employed for the specified purpose are that the apparatus be one-piece, not require any assembly, and be so shaped as to be stackable in nested conditions relative to numerous other identical paper cutters—such stacking occurring during shipment from any desired factory area to a point or points of packaging and distribution.

SUMMARY OF THE INVENTION

The apparatus comprises an elongate cradle and cutting element adapted to cradle a conventional roll of gift-wrap paper having a cardboard core. The cradle and cutting element is sufficiently small that it may be readily held in one hand of the operator, and is sufficiently large that the gift-wrap roll may rotate therein without danger of falling out and without necessity for any connection between the cradle/cutting element and the roll.

In the preferred embodiment, the cradle/cutting element is V-shaped, and is an obtuse angle in transverse section, with each side of the V having a dimension of about one and one-half inches. The length of the cradle/cutting element is at least equal to the length of a conventional gift-wrap roll.

The full length of the free edge of one side is sharp but not knife-sharp, while the free edge of the other side is a bead that increases the comfort of the operator, and augments longitudinal strength and stability. The cradle/cutting element is formed of synthetic resin, for example one extruded in one piece. The side of the V having the cutting edge is provided along most or all of its length with ruler markings, to aid in determining how much gift paper to cut during a below-indicated second stage of the cutting operation.

In accordance with the method, and assuming that the operator is right-handed, the left hand grasps the cradle/cutting element from below and in such orientation that the upper side is concave. At substantially the same time, the right hand of the operator grabs a roll of gift-wrap paper and drops or places it in the cradle/cutting element, where it is held by gravity.

The operator then pulls generally upwardly on the free edge of the gift-wrap paper, so that the roll rotates freely in the cradle without obstruction or drag by anything, the only force holding the roll of wrapping paper down being normally only gravity. Because gravity is employed, there is a uniform, widely-distributed force holding the roll to the cradle/cutting element, and the roll turns easily.

After the desired amount of gift-wrap paper has been pulled from the roll, the left hand of the operator is caused to simultaneously grasp the roll and the cradle/cutting element—preventing further turning—and the right hand is employed to bring the paper against the cutting edge and make the cut.

As a second step in the cutting operation, relative to smaller packages, the cut-off end of gift-wrap paper is laid on a table top or on the floor, and the cradle/cutting element is placed thereon with the cutting edge facing downwardly. One or more tears are then made, and the ruler markings on the apparatus are employed to determine size.

BRIEF DESCRIPTION OF THE DRAWINGS

FIG. 1 is an isometric view, as viewed from above, of a cradle/cutting element incorporating the present invention;

FIG. 2 is an isometric view illustrating gift-wrap paper being pulled from a roll thereof, while the roll is supported in the cradle/cutting element which in turn is supported by the left hand of the operator;

FIG. 3 is an isometric view showing the tearing of the paper by pulling it against the cutting edge of the cradle/cutting element; and FIG. 4 is a vertical sectional view showing the relationship between the parts during the procedure indicated in FIG. 3, the left hand of the operator being unshown.

DETAILED DESCRIPTION OF THE PREFERRED EMBODIMENT

Referring first to FIG. 1, the cradle/cutting element (cradle element) is indicated at 10 and is extremely simple and economical. It is made by extrusion, of a synthetic resin such as styrene. In the preferred form of the apparatus 10, the cradle/cutting element is about thirty inches long, namely thirty-two inches long, and weighs about seven ounces. The apparatus 10 is straight not curved. It may be sold for only a few dollars.

The apparatus has two planar elongate sides 11,12 (FIGS. 1 and 4) that are integrally connected to each other at a corner 13. Each side 11,12 is about one and one-half inches wide, with side 12 preferably being slightly wider than side 11.

Stated otherwise, the widths of the sides 11,12, and the angle between them, are so selected that a conventional roll 14 of gift-wrap paper 15 will—by gravity—be cradled or nested securely in the concave upper side of the apparatus 10 when such upper side is in the generally upwardly-facing position shown in FIGS. 1 and 2. On the other hand, the dimensions are so selected that only one hand of the operator may readily grasp the apparatus 10 as shown in FIGS. 2 and 3, and may comfortably and easily manipulate the apparatus as below described. The "operator" referred to herein is a normal-size adult person.

The two sides 11,12 are at an obtuse angle relative to each other. Such obtuse angle is sufficiently large that the gift-roll 14 may fit far down into the convex upper side (FIG. 2), but sufficiently small that the axis of the roll 14 will remain in the same position relative to the element 10 during operations including pulling of paper 15 off of roll 14. For example, an obtuse angle of 170 degrees would not be desired. The preferred obtuse angle is about 115 degrees as shown in FIG. 4.

Integrally provided on the free edge of side 10, during the extrusion or other manner of manufacture, is a straight cutting edge 17. The outer edge of side 11 is, conversely, formed with a bead 18 that increases the comfort of the contact between such edge 18 and the operator, and augments longitudinal strength and stability. Cutting edge 17 is sufficiently sharp that it will cut the paper 15 when a firm, rapid tearing force is provided by one hand of the operator; but the cutting edge is preferably not knife-sharp.

The roll 14 and paper 15 thereon are conventional gift-wrap paper, the paper being typically quite thin and highly decorative. The roll 14 has a cylindrical tubular cardboard core 20 that keeps the exterior surface of the rolled paper cylindrical and that keeps the roll 14 straight. The length of roll 14 is typically about thirty inches, and the diameter about two inches.

Indicia 21 in the form of a conventional ruler are printed on the exterior flat surface of side 12, as shown in FIG. 3, along the cutting edge 17.

Method and Operation

To simplify the description, it is assumed that the operator is right-handed. The operator has a left hand 22 and a right hand 23. For left-handed operators, everything is reversed.

While standing or seated next to a table, or while kneeling or sitting on a floor, the operator merely grasps the cradle/cutting element 10 in his/her left hand 22, preferably at about the middle of the element 10 as shown. The concave side of the apparatus 10 is caused to face upwardly, as illustrated in FIG. 2. At or about the same time the left hand 22 is grasping the apparatus 10, the right hand 23 grasps a roll 14 of gift-wrap paper 15 and merely lays of drops the roll onto the concave side of the apparatus 10 so that it is cradled by such apparatus.

In one form of operation of the apparatus, cutting edge 17 is caused to be at the left of the upwardly-concave cradle/cutting apparatus. Also, the free edge of the paper 15 is caused to be at the left, being adjacent cutting edge 17 instead of adjacent bead 18. Then, the operator merely grasps paper 15 and elevates his/her right hand 23 to unroll whatever length of paper 15 is desired. During this period, the roll 14 rests by gravity on the concave upper side of apparatus 10, freely rotating thereon without binding.

After the desired length of paper 15 has been unrolled, the operator closes the fingers of his/her left hand 22 around roll 14 so as to secure such roll against the concave upper side of apparatus 10. At substantially the same time, the operator rotates his/her left wrist so as to turn the combination over from the FIG. 2 position to the FIG. 3 position, the concave side of the apparatus 10 then facing downwardly and having the roll 14 securely held thereto by the fingers of the left hand 23.

It is then merely necessary that the right hand 23 of the operator grasps the free end of the paper 15 and pulls sharply upwardly so that the cutting edge 17 causes the paper to cut along such edge. The right hand 23 is elevated during this motion, sufficiently far that all of the extending portion of paper 15 is cut.

In another manner of operation of the tool, the position shown in FIG. 2 is repeated except that the cradle/cutting element 10 is disposed with its cutting edge 17 on the right (FIG. 1) and its beaded edge 18 on the left. Furthermore, the free end of paper 15 is caused to be on the right-adjacent cutting edge 17. After the desired length has been pulled upwardly from the roll, while the roll rotates freely, a cutting operation is performed. This is done by closing the fingers of hand 22 on the roll to clamp it against the cradle/cutting apparatus, and by employing the right hand 23 to pull down sharply on the paper 15 so that a cut is made along the cutting edge 17.

When smaller pieces of gift-wrap paper 15 are desired, a second step is performed. The cut-off piece of paper 15 is laid on a tabletop or on the floor. Then, the ruler 21 is employed to measure off however many inches of the severed paper 15 it is desired to again cut. Then, the apparatus 10 is disposed above the paper on the tabletop or floor, concave side facing downwardly, with cutting edge 17 manually pressed against the place on the paper 15 where the cut is desired. While holding the apparatus 10 downwardly with his/her left hand 22, the operator lifts on the paper with his/her right hand to make a cut. If any even smaller piece is desired, this operation may be repeated-typically with the apparatus 10 at right angles to the position it was disposed in when the second cut was made.

The foregoing detailed description is to be clearly understood as given by way of illustration and example only, the spirit and scope of this invention being limited solely by the appended claims.

What is claimed is:

1. A method of cutting a straight-sided piece of gift-wrap paper from a conventional roll thereof, said conventional roll of paper being generally about 30 inches long and about 2 inches in diameter, said roll having a cylindrical tubular core, said method comprising providing an elongate open-topped upwardly-concave cradle element the length of which is at least about equal to the length of said roll, said element having opposed edges that are spaced from each other a substantial distance, one of said opposed edges being a cutting edge, employing the left hand of a normal-size adult person to hold said cylindrical cutting element with the concave upper side thereof facing generally upwardly, disposing in said cradle element said conventional roll of gift-wrap paper, causing the orientation of said roll relative to that of said element to be such that the free end of the gift-wrap paper in said roll is on the side of said element that is adjacent said cutting edge, employing the right hand of said person to pull generally upwardly on said free end to thereby cause gift-wrap paper to be fed from said roll and to cause said roll to rotate freely in said element, employing said left hand to simultaneously grasp said roll and said element to clamp said roll against said element and prevent further rotation of said roll, employing said left hand to turn said element upside down so that said roll faces downwardly from said element, and said roll and said element are held in said left hand, and employing said right hand to pull upwardly on said free end in such manner that said paper is pulled against said cutting edge and is cut thereby in a straight line.

2. A method of cutting a straight-sided piece of gift-wrap paper from a conventional roll thereof, said conventional roll of paper being generally about 30 inches long and about 2 inches in diameter, said roll having a cylindrical tubular core, said method comprising providing an elongate open-topped upwardly-concave cradle element the length of which is at least about equal to the length of said roll, said element having opposed edges that are spaced from each other a substantial distance one of said opposed edges being a cutting edge, employing the left hand of a normal-size adult person to hold said cylindrical cutting element with the concave upper side thereof facing generally upwardly, disposing in said cradle element said conventional roll of gift-wrap paper, causing the orientation of said roll relative to that of said element to be such that the free end of the gift-wrap paper in said roll is on the side of said element that is adjacent said cutting edge, employing the right hand of said person to pull generally upwardly on said free end to thereby cause gift-wrap paper to be fed from said roll and to cause said roll to rotate freely in said element, employing said left hand to simultaneously grasp said roll and said element to clamp said roll against said element and prevent further rotation of said roll, employing said right hand to pull on said free end in such manner that said paper is pulled against said cutting edge and is cut thereby in a straight line, and further comprising disposing the thus cut-off section of said gift-wrap paper on a horizontal surface, placing said cradle element thereon, pressing down on said element causing said cutting edge to be against said paper section, and pulling up on said section to bring said section against said cutting edge and again cut said paper.

3. Hand-held apparatus for making straight cuts of gift-wrap paper from a conventional roll thereof, said conventional roll of paper being generally about 30 inches long and about 2 inches in diameter and having a cylindrical tubular core, said apparatus consisting of an elongate cradle element, said element being straight and being sufficiently long to hold the conventional roll of gift-wrap paper having said cylindrical tubular core, said element being concave on one side, the amount of concavity and the cross-sectional size of said element being sufficiently large that said concave side will cradle said conventional roll of gift-wrap paper without danger that said roll will fall off said element when paper is pulled upwardly from said roll while said concave side faces upwardly and said roll is cradled by gravity on said concave side, said element having a straight cutting edge along one side thereof, said element being sufficiently small and light that it can be readily held in one hand of a normal-size adult person while the other hand of such person is pulling gift-wrap paper from said roll against said cutting edge for cutting of said paper at said cutting edge, and said element also being sufficiently small that the fingers of said one hand can clamp said roll against said element during said last-mentioned pulling and said cutting, said cradle element not having end portions that extend into said roll, said cradle element being V-shaped in Cross-section, and said V-shaped cradle element having two sides, said two sides being at a relatively small obtuse angle to each other.

4. The invention as claimed in claim 1, in which said element is a synthetic resin extrusion having a length of about 30 inches.

5. The invention as claimed in claim 1, in which each of said sides of said V-shaped cradle element has a width of about 1.5 inches.

6. The invention as claimed in claim 1, in which said element has a bead along the other side thereof.

* * * * *